US005146140A

United States Patent [19]

Piejak et al.

[11] Patent Number: 5,146,140

[45] Date of Patent: Sep. 8, 1992

[54] METHOD AND APPARATUS TO REDUCE HG LOSS IN RF CAPACITIVELY COUPLED GAS DISCHARGES

[75] Inventors: Robert B. Piejak, Wayland; Valery A. Godyak, Brookline; Benjamin M. Alexandrovich, Watertown, all of Mass.

[73] Assignee: GTE Products Corporation, Danvers, Mass.

[21] Appl. No.: 717,137

[22] Filed: Jun. 18, 1991

[51] Int. Cl.[5] ..... H05B 41/16

[52] U.S. Cl. ..... 315/248; 315/39

[58] Field of Search ..... 315/248, 39, 344, 267; 313/234, 635, 607

[56] References Cited

U.S. PATENT DOCUMENTS

| | | | |
|---|---|---|---|
| 4,223,250 | 9/1980 | Kramer | 315/248 |
| 4,266,166 | 5/1981 | Proud | 315/39 |
| 4,798,997 | 1/1989 | Egami | 315/248 |

*Primary Examiner*—Eugene R. LaRoche
*Assistant Examiner*—A. Zarabian
*Attorney, Agent, or Firm*—Carl F. Ruoff; Frances P. Craig

[57] ABSTRACT

A method and apparatus which prevent mercury and fill gas loss in capacitively coupled electrodeless lamps operated at low frequencies (below 100 MHz). The lamp includes a lamp envelope with an inner coating of phosphor. Outer electrodes coupled to a radio frequency source are positioned around the outer surface of the lamp envelope. The lamp contains a fill gas (e.g. mercury and argon) which forms a plasma causing UV radiation which excites the phosphor. Mercury loss is prevented by providing a pair of inner conductors aligned with the outer conductors but electrically insulated therefrom. The inner conductors prevent the mercury and fill gas ions from embedding themselves in the lamp envelope.

10 Claims, 1 Drawing Sheet

METHOD AND APPARATUS TO REDUCE HG LOSS IN RF CAPACITIVELY COUPLED GAS DISCHARGES

BACKGROUND OF THE INVENTION

The present invention relates to a method and apparatus for increasing the lifetime of low pressure Hg/Rare Gas capacitively coupled rf discharge lamps. More, specifically, the present invention relates to a method and lamp which inhibits Hg and rare gas loss in the lamp vessel.

Electrodeless low pressure Hg/Ar discharge lamps offer a number of significant advantages over conventional fluorescent lamps. They require no electrodes thus eliminating electrode failure and resulting in a long lasting lamp. Potentially, they have reduced electrode losses and thus can be highly efficacious. In addition, they remove some constraints on lamp geometry, they may use chemically reactive constituents and they can be made cheaply.

Electrodeless low pressure discharges can be generally categorized as inductive, capacitive, or surface wave coupled. The invention introduced here is concerned with capacitively coupled low pressure discharge lamps. Capacitively coupled lamps have been demonstrated in U.S. Pat. No. 4,266,166 using a 915 MHz rf source. Typically these lamps have all the advantages listed above however they require a high frequency power source which is relatively expensive. To reduce cost of the power source capacitively coupled discharges have been operated at lower driving frequencies. However, the lifetime of such lamps was unacceptable.

When lamps are capacitively driven at frequencies below 100 MHz they possess the same advantages as mentioned above, however, they may have a fairly short life span. After a few days of continuous operation at discharge currents (and light output) comparable to conventionally (electronic or magnetic ballast) driven fluorescent lamps, the Hg in the lamp vanishes and subsequently the argon buffer gas disappears until there is virtually nothing left in the lamp volume and the discharge ceases. When studied under postmortem analysis these lamps have dark patches where much of the Hg in the lamp volume has imbedded itself in the phosphor and in the glass envelope; eventually the argon buffer gas suffers the same fate. In the areas where the Hg is lost, the phosphor in the lamp and the glass underneath it is generally brown or black. The areas of Hg loss are always where the electrodes are connected to the lamp body and where capacitive coupling is applied. Apparently, the ions of Hg (and later, argon) are accelerated by the dc potential between the plasma and the discharge vessel surface, they impact on the non-conducting glass surface and they are permanently lost from the discharge volume. This same phenomena is avoided at higher frequencies (i.e. microwave frequencies) because at these frequencies the sheath voltages are significantly lower resulting in ion bombardment energy that is insufficient to imbed the ion into the phosphor or glass substrate.

The present invention avoids this problem in a unique and novel manner.

SUMMARY OF THE INVENTION

The present invention is a capacitively coupled lamp that can be driven at low frequencies while inhibiting loss of mercury and argon in the lamp fill. The lamp includes a lamp envelope enclosing a fill material which forms during discharge a plasma emitting ultraviolet radiation. The inner surface of the envelope is coated with a phosphor which emits visible light when excited by ultraviolet radiation. A pair of outer conductors are positioned around the outer surface of the lamp envelope and capacitively couple power to the lamp fill from a rf source. Inner conductors positioned on the inner surface of the lamp, aligned with the outer conductors but electrically insulated therefrom prevent Hg and lamp fill loss while the lamp is in operation.

In a related aspect of the invention, a method of reducing mercury and argon loss in a capacitively coupled lamp wherein power is coupled to the lamp by external electrodes is achieved by aligning a metal conductor on an inner surface of the lamp envelope with the external electrodes. The inner conductor prevents the imbedding of mercury ions and argon ions into the lamp envelope or phosphor layer thereby increasing the lamp life.

Figure 1:
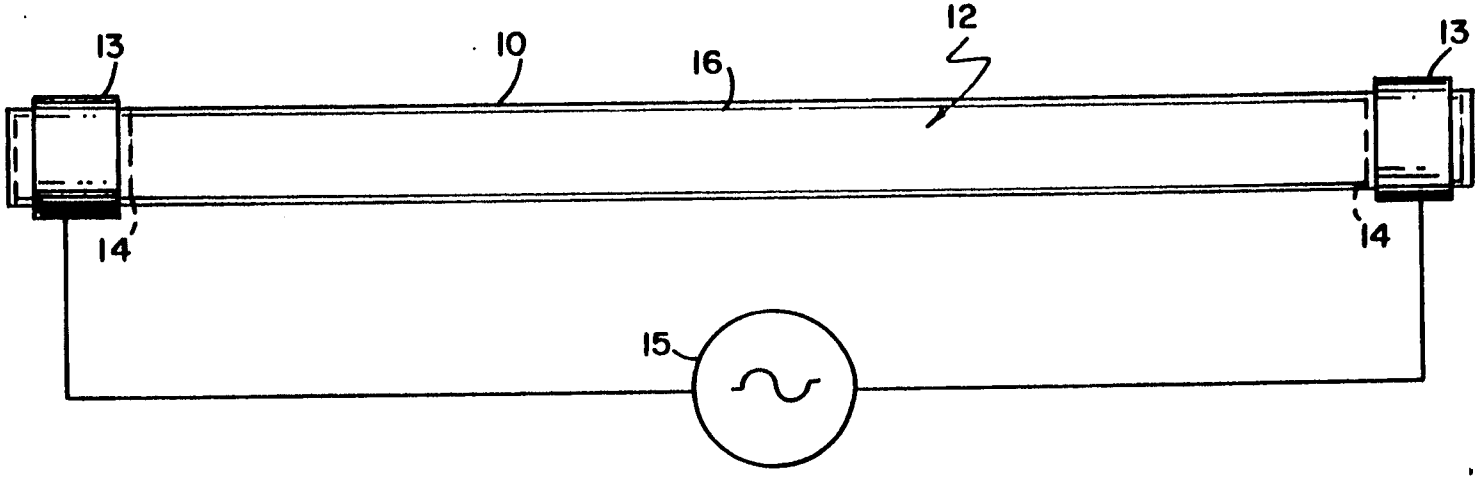
FIG. 1 shows the capacitively coupled lamp of the present invention.

For a better understanding of the present invention together with other advantages and capabilities thereof, reference is made to the following description and appended claims in connection with the preceding drawing.

DETAILED DESCRIPTION OF THE PREFERRED EMBODIMENTS

Capacitively coupling the discharge current through the glass envelope from an outer electrode is a routine way to drive an electrodeless lamp. To limit the Hg/Ar loss however, the present invention discloses a lamp in which there are electrode bands on the inside as well as the outside of the lamp envelope but with no connection between the two (no glass to metal feedthrough junctions). In so doing, the ions will then impinge upon a conductor rather than the glass discharge vessel. The addition of the inner band electrode helps discourage Hg loss. The result of this technique is to reduce and eliminate the Hg loss in the glass and phosphor. This technique increases lamp life when driven at low radio frequencies (10–100 MHz) while maintaining all the other advantages of electrodeless operation.

FIG. 1 shows one embodiment of the present invention. The low pressure discharge tube 10 has a Hg/rare gas fill 12 as in a conventional fluorescent lamp. Typically, argon is used although neon is also suitable. It has no emissive electrodes or electrical feedthroughs. Power is coupled into the lamp by attaching external electrodes 13 to the glass wall of the discharge tube so as to cover (and thereby couple closely to) the hollow cylindrical metal bands 14 inside the discharge tube itself. Low frequency power is coupled to the external electrodes by rf source 15. By terminating the rf discharge on a metal conductor the imbedding of the Hg and argon is inhibited. Apparently electrons recombine with the ions on the metal surface and atomic mercury is formed on the surface and released. To our knowledge almost any metal conductor that does not form an amalgam may be used for this purpose. Nickel is the preferred material as the inner metal conductor because it is inexpensive, it is easily formed and it does not react with Hg. When a non-conductor such as glass or phosphor is bombarded with high energy ions the ions are trapped in the atomic lattice structure of non-conducting solid and presumably react chemically with the lattice itself thus becoming entrapped. The surface of insulators subjected to rf excitation have been studied using electron microscopy and Hg and argon can be readily identified in the phosphor and in the glass where energetic ion bombardment occurred. Typical operating conditions that result in catastrophic lamp failure due to ion bombardment include an operating frequency of 13 MHz, 1 torr of gas pressure and an 100mA/cm$^2$ at the electrodes. By aligning inner conductors with the electrodes on the inner surface of the lamp catastrophic failure is prevented. When the gas fill is excited it emits ultraviolet radiation which excites the phosphor 16 and visible light is emitted.

Although the beneficial effects of the lamp of the present invention are greatest for low frequency driven lamps the technique can be applied to any E-type discharge, even at high frequencies i.e. 915–2450 MHz. In addition, other embodiments of the present invention include having a metal foil or film applied to the inner surface of the lamp envelope. The film or foil must be thick enough that a significant number of ions cannot penetrate through the film or foil and imbed themselves into the lamp envelope.

Moreover, the present invention can be applied to twin tubes or double twin tubes or any other geometry where capacitive coupling is employed.

While there has been shown and described what are at present considered the preferred embodiments of the invention, it will be obvious to those skilled in the art that various changes and alterations may be made without departing from the scope of the invention as defined by the appended claims.

What is claimed is:

1. A capacitively coupled lamp comprising a lamp envelope made of a light transmitting material, said envelope having an outer surface and an inner surface, said inner surface enclosing a fill material which forms during discharge a plasma which emits ultraviolet radiation;

a phosphor layer covering the inner surface of said lamp envelope and emitting visible light when excited by ultraviolet radiation;

a pair of outer conductors positioned on the outer surface of said lamp envelope;

a pair of inner conductors positioned on the inner surface of said lamp envelope and aligned with said pair of outer conductors and electrically insulated therefrom;

an rf source coupled to said outer conductors capable of producing low frequency power below 100 MHz;

wherein low frequency power below 100 MHz applied to said outer conductors induces an electric field in said lamp and discharge therein without loss of said fill material.

2. The lamp according to claim 1 wherein said inner conductors are made of nickel.

3. The lamp according to claim 1 wherein said fill material comprise mercury and argon.

4. A capacitively coupled lamp comprising:

a lamp envelope having an inner surface and an outer surface, the inner surface enclosing a lamp fill volume;

a phosphor layer covering the inner surface of said lamp envelope which emits visible light when excited by ultraviolet radiation;

a fill material within the lamp fill volume which emits ultraviolet radiation upon breakdown and excitation;

a pair of outer conductors disposed around the outer surface of the lamp envelope capable of coupling low frequency rf power below 100 MHz to said fill material;

a pair of inner conductors disposed on the inner surface of the lamp envelope aligned with the pair of outer conductors and electrically insulated therefrom.

5. The lamp according to claim 4 wherein said fill material includes mercury and at least one inert gas.

6. The lamp according to claim 4 further comprising a source of low frequency power below 100 MHz coupled to said pair of outer conductors.

7. The lamp according to claim 6 wherein the source of power has a frequency in the range from 10 MHz to below 100 MHz.

8. A method of reducing mercury and rare gas loss in a capacitively coupled lamp wherein low freqency rf power below 100 MHz is coupled to the lamp by external electrodes positioned around an outer surface of a lamp envelope, said method comprising the step of:

aligning one or more metal conductors on an inner surface of said lamp envelope with the external electrodes but electrically insulated therefrom, said metal conductors preventing the imbedding of mercury ions and rare gas ions into the lamp envelope during low frequency (below 100 MHz) operation thereby increasing the life of the lamp.

9. The method according to claim 8 wherein the metal conductors are made of nickel.

10. The lamp according to claim 1 wherein said fill material comprises mercury and a rare gas.

* * * * *